US008333848B2

(12) United States Patent
Ozeki et al.

(10) Patent No.: US 8,333,848 B2
(45) Date of Patent: Dec. 18, 2012

(54) PERMANENT MAGNET AND PROCESS FOR PRODUCING PERMANENT MAGNET

(75) Inventors: Izumi Ozeki, Osaka (JP); Katsuya Kume, Osaka (JP); Junichi Nakayama, Osaka (JP); Yuuki Fukuda, Osaka (JP); Toshinobu Hoshino, Osaka (JP); Tomokazu Horio, Osaka (JP)

(73) Assignee: Nitto Denko Corporation, Osaka (JP)

( * ) Notice: Subject to any disclaimer, the term of this patent is extended or adjusted under 35 U.S.C. 154(b) by 0 days.

(21) Appl. No.: 12/937,831

(22) PCT Filed: Apr. 14, 2009

(86) PCT No.: PCT/JP2009/057530

§ 371 (c)(1),
(2), (4) Date: Oct. 14, 2010

(87) PCT Pub. No.: WO2009/128458

PCT Pub. Date: Oct. 22, 2009

(65) Prior Publication Data

US 2011/0037548 A1 Feb. 17, 2011

(30) Foreign Application Priority Data

Apr. 15, 2008 (JP) ..... 2008-105759

(51) Int. Cl.
*H01F 1/057* (2006.01)

(52) U.S. Cl. ..... 148/302; 419/12; 75/244; 148/101

(58) Field of Classification Search ..... None
See application file for complete search history.

(56) References Cited

U.S. PATENT DOCUMENTS 3,892,599 A 7/1975 Smeggil et al.
4,776,902 A * 10/1988 Ghandehari ..... 148/103

FOREIGN PATENT DOCUMENTS

EP 0991086 A1 4/2000
JP 62-284002 A 12/1987
JP 1-150303 A 6/1989
JP 3-14204 A 1/1991
JP 4-26104 A 1/1992

(Continued)

OTHER PUBLICATIONS

Patent Abstracts of Japan, Publication No. 03-014204, Jan. 22, 1991.*

(Continued)

*Primary Examiner* — John Sheehan
(74) *Attorney, Agent, or Firm* — Sughrue Mion, PLLC

(57) ABSTRACT

The present invention relates to a permanent magnet manufactured by steps of: wet-pulverizing a high-melting metal element-containing organic compound or a precursor of a high-melting ceramic in a solvent together with a magnet raw material to pulverize the magnet raw material into fine particles having a grain size of 3 μm or less and to coat a surface of the pulverized magnet raw material with the high-melting metal element-containing organic compound or the precursor of the high-melting ceramic; adding a resin binder to the magnet raw material coated with the high-melting metal element-containing organic compound or the precursor of the high-melting ceramic; producing a slurry by kneading the magnet raw material and the resin binder; molding the slurry into a sheet form to prepare a green sheet; and sintering the green sheet.

6 Claims, 4 Drawing Sheets

FOREIGN PATENT DOCUMENTS

| | | | |
|---|---|---|---|
| JP | 11-307330 | A | 11/1999 |
| JP | 2002-164239 | A | 6/2002 |
| JP | 2004-250781 | A | 9/2004 |
| JP | 2006-286819 | A | 10/2006 |
| WO | 2005/052960 | A2 | 6/2005 |

OTHER PUBLICATIONS

Machine Translation of Japanese Document 2005-191282 Jul. 14, 2005.*

International Search Report [PCT/ISA/210] issued Jul. 21, 2009, in counterpart International Application No. PCT/JP2009/057530.

Written Opinion [PCT/ISA/237] issued Jul. 21, 2009, in counterpart International Application No. PCT/JP2009/057530.

Extended European Search Report issued Apr. 18, 2011 in counterpart European Application No. 09731775.4.

Communication dated Mar. 28, 2012 issued by the State Intellectual Property Office of the People's Republic of China in Chinese Application No. 200980113298.4.

* cited by examiner

PERMANENT MAGNET AND PROCESS FOR PRODUCING PERMANENT MAGNET

TECHNICAL FIELD

The present invention relates to a permanent magnet and a method for manufacturing the permanent magnet.

BACKGROUND ART

In recent years, a reduction in size and weight, an increase in power and an increase in efficiency have been required for permanent magnetic motors used in hybrid cars, hard disk drives or the like. In particular, with recent requirement for a reduction in size of the hard disk drives, a further reduction in size and thickness has been required for voice coil motors (hereinafter referred to as VCMs) used for head driving of the hard disk drives as shown in patent document 1 (JP-A-2006-286819).

Then, in realizing the reduction in size and thickness in the above-mentioned VCMs, a reduction in film thickness and further improvement in magnetic characteristics have been required for permanent magnets buried in the VCMs. Incidentally, as the permanent magnets, there are ferrite magnets, Sm—Co-based magnets, Nd—Fe—B-based magnets, $Sm_2Fe_{17}N_x$-based magnets and the like. In particular, Nd—Fe—B-based magnets having high coercive force are used as the permanent magnets for the permanent magnet motors.

Here, as a method for manufacturing the permanent magnet used in the permanent magnet motor, a powder sintering method is generally used. In the powder sintering method as used herein, a raw material is first pulverized with a jet mill (dry pulverization) to produce a magnet powder as shown in FIG. 5. Thereafter, the magnet powder is placed in a mold, and press molded to a desired shape while applying a magnetic field from the outside. Then, the solid magnet powder molded to the desired shape is sintered at a predetermined temperature (for example, 1100° C. in the case of the Nd—Fe—B-based magnet), thereby manufacturing the permanent magnet.

BACKGROUND ART DOCUMENTS

PATENT DOCUMENTS

Patent Document 1: JP-A-2006-286819 (Page 2, Page 3, FIG. 4)

Patent Document 2: JP-A-2004-250781 (Pages 10 to 12, FIG. 2)

SUMMARY OF THE INVENTION

However, when the permanent magnet is manufactured by the above-mentioned powder sintering method, there have been the following problems. That is to say, in the powder sintering method, it is necessary to secure a predetermined porosity in a press-molded magnet powder in order to perform magnetic field orientation. And when the magnet powder having the predetermined porosity is sintered, it is difficult to uniformly perform contraction which occurs at the time of sintering, and deformations such as warpage and depressions occur after sintering. Further, since pressure unevenness occurs at the time of pressing the magnet powder, sparse and dense of the magnet after sintering are formed to generate strain on a surface of the magnet. Conventionally, it has therefore been required to compression-mold the magnet powder to a larger size than that of a desired shape, previously assuming that strain is generated on the surface of the magnet. Then, cutting and polishing operations have been performed after sintering to perform processing for correcting to the desired shape. As a result, manufacturing processes increase, and there is a possibility of deteriorating qualities of the permanent magnet manufactured.

Further, particularly in the permanent magnet used in the VCMs as described above, a reduction in film thickness (for example, 1 mm or less in thickness) has been required. And the magnet reduced in film thickness has a large ratio of a processing-deteriorated layer on a surface, which occurs in the case of processing the surface, compared to a thick magnet. Accordingly, when the thin film-like permanent magnet is manufactured by the above-mentioned powder sintering method, a problem of further deteriorating magnetic characteristics has also been encountered.

On the other hand, it has been known that the magnetic characteristics of the permanent magnet are basically improved by miniaturizing the crystal grain size of a sintered body, because the magnetic characteristics of the magnet is derived by a single-domain fine particle theory. In general, when the crystal grain size of the sintered body is adjusted to 3 μm or less, it becomes possible to sufficiently improve the magnetic performance.

Here, in order to miniaturize the crystal grain size of the sintered body, it is necessary to also miniaturize the grain size of a magnet raw material before sintering. However, even when the magnet raw material finely pulverized to a grain size of 3 μm or less is molded and sintered, grain growth of magnet particles occurs at the time of sintering. Accordingly, the crystal grain size of the sintered body after sintering has not been able to be reduced to 3 μm or less.

Accordingly, there is considered a method of adding a material for inhibiting the grain growth of the magnet particles (hereinafter referred to as a grain growth inhibitor) to the magnet raw material before sintering. According to this method, it becomes possible to inhibit the grain growth of the magnet particles at the time of sintering, for example, by coating surfaces of the magnet particles before sintering with a grain growth inhibitor such as a metal compound having a melting point higher than a sintering temperature. For example, phosphorus (P) is added as the grain growth inhibitor to a magnet powder in patent document 2. However, when the grain growth inhibitor is added to the magnet powder by allowing it to be previously contained in an ingot of the magnet raw material, as described in the above-mentioned patent document 2, the grain growth inhibitor is not positioned on the surfaces of the magnet particles after sintering, and diffused into the magnet particles. As a result, the grain growth at the time of sintering cannot be sufficiently inhibited. Further, this has also contributed to a decrease in residual magnetization of the magnet.

The invention has been made in order to solve the above-mentioned conventional problems, and an object of the invention is to provide a permanent magnet in which the deformations such as warpage and depressions do not occur after sintering, because the contraction due to sintering becomes uniform by formation of a green sheet, further which requires no correcting processing after sintering to be able to simplify the manufacturing processes, because the pressure unevenness at the time of pressing disappears, and in which the crystal grain size of the sintered body is adjusted to 3 μm or less to make it possible to improve the magnetic performance, because the grain growth of the magnet particles at the time of sintering can be inhibited by coating a surface of the magnet raw material with a high-melting metal element-containing organic compound or a precursor of a high-melting ceramic; and a method for manufacturing the permanent magnet.

Namely, the present invention relates to the following items (1) to (5).

(1) A permanent magnet manufactured by steps of:

wet-pulverizing a high-melting metal element-containing organic compound or a precursor of a high-melting ceramic in a solvent together with a magnet raw material to pulverize the magnet raw material into fine particles having a grain size of 3 μm or less and to coat a surface of the pulverized magnet raw material with the high-melting metal element-containing organic compound or the precursor of the high-melting ceramic;

adding a resin binder to the magnet raw material coated with the high-melting metal element-containing organic compound or the precursor of the high-melting ceramic;

producing a slurry by kneading the magnet raw material and the resin binder;

molding the slurry into a sheet form to prepare a green sheet; and sintering the green sheet.

Incidentally, the term "high-melting metal element-containing organic compound" means a compound containing a high-melting metal atom or a high-melting metal ion which forms an ionic bond and/or a covalent bond and/or a coordination bond through an atom, which is generally contained in organic compounds, such as carbon, nitrogen, oxygen, sulfur and phosphorus.

(2) A permanent magnet manufactured by steps of:

pulverizing a magnet raw material into fine particles having a grain size of 3 μm or less;

wet-mixing a high-melting metal element-containing organic compound or a precursor of a high-melting ceramic in a solvent together with the pulverized magnet raw material, thereby coating a surface of the pulverized magnet raw material with the high-melting metal element-containing organic compound or the precursor of the high-melting ceramic;

adding a resin binder to the magnet raw material coated with the high-melting metal element-containing organic compound or the precursor of the high-melting ceramic;

producing a slurry by kneading the magnet raw material and the resin binder;

molding the slurry into a sheet form to prepare a green sheet; and sintering the green sheet.

(3) The permanent magnet according to (1) or (2), in which the high-melting metal element-containing organic compound or the precursor of the high-melting ceramic is unevenly distributed in a grain boundary of the magnet raw material after sintering.

(4) A method for manufacturing a permanent magnet including steps of:

wet-pulverizing a high-melting metal element-containing organic compound or a precursor of a high-melting ceramic in a solvent together with a magnet raw material to pulverize the magnet raw material into fine particles having a grain size of 3 μm or less and to coat a surface of the pulverized magnet raw material with the high-melting metal element-containing organic compound or the precursor of the high-melting ceramic;

adding a resin binder to the magnet raw material coated with the high-melting metal element-containing organic compound or the precursor of the high-melting ceramic;

producing a slurry by kneading the magnet raw material and the resin binder;

molding the slurry into a sheet form to prepare a green sheet; and sintering the green sheet.

(5) A method for manufacturing a permanent magnet including steps of: pulverizing a magnet raw material into fine particles having a grain size of 3 μm or less;

wet-mixing a high-melting metal element-containing organic compound or a precursor of a high-melting ceramic in a solvent together with the pulverized magnet raw material, thereby coating a surface of the pulverized magnet raw material with the high-melting metal element-containing organic compound or the precursor of the high-melting ceramic;

adding a resin binder to the magnet raw material coated with the high-melting metal element-containing organic compound or the precursor of the high-melting ceramic;

producing a slurry by kneading the magnet raw material and the resin binder;

molding the slurry into a sheet form to prepare a green sheet; and sintering the green sheet.

According to the permanent magnet having the constitution of the above (1), the permanent magnet is constituted by the magnet obtained by sintering the green sheet obtained by mixing the magnet raw material with the resin binder and molding the resulting mixture. Accordingly, the contraction due to sintering becomes uniform, whereby the deformations such as warpage and depressions do not occur after sintering, and further, it is unnecessary to perform the conventional correcting processing after sintering, which can simplify the manufacturing processes, because the pressure unevenness at the time of pressing disappears. Therefore, it becomes possible to mold the permanent magnet with a high degree of dimension accuracy. Furthermore, even when the permanent magnet is reduced in film thickness, the magnetic characteristics are not deteriorated by the processing-deteriorated layer on the surface.

In addition, the surfaces of the pulverized magnet particles are coated with the high-melting metal element-containing organic compound or the precursor of the high-melting ceramic by performing wet mixing, so that the grain growth of the magnet particles at the time of sintering can be inhibited. Accordingly, it becomes possible to adjust the crystal grain size of the sintered body to 3 μm or less to improve the magnetic performance.

Further, according to the permanent magnet described in the above (2), the permanent magnet is constituted by the magnet obtained by sintering the green sheet obtained by mixing the magnet raw material with the resin binder and molding the resulting mixture. Accordingly, the contraction due to sintering becomes uniform, whereby the deformations such as warpage and depressions do not occur after sintering, and further, it is unnecessary to perform the conventional correcting processing after sintering, which can simplify the manufacturing processes, because the pressure unevenness at the time of pressing disappears. Therefore, it becomes possible to mold the permanent magnet with a high degree of dimension accuracy. Furthermore, even when the permanent magnet is reduced in film thickness, the magnetic characteristics are not deteriorated by the processing-deteriorated layer on the surface.

In addition, the surfaces of the pulverized magnet particles are coated with the high-melting metal element-containing organic compound or the precursor of the high-melting ceramic by performing wet mixing, so that the grain growth of the magnet particles at the time of sintering can be inhibited. Accordingly, it becomes possible to adjust the crystal grain size of the sintered body to 3 μm or less to improve the magnetic performance.

Further, according to the permanent magnet described in the above (3), the high-melting metal element-containing organic compound or the precursor of the high-melting ceramic is unevenly distributed in the grain boundary of the magnet raw material after sintering, so that it becomes possible to inhibit the grain growth of the magnet particles at the time of sintering without decreasing the residual magnetization of the magnet.

Further, according to the method for manufacturing a permanent magnet described in the above (4), the permanent magnet is manufactured by sintering the green sheet obtained by mixing the magnet raw material with the resin binder and molding the resulting mixture. Accordingly, the contraction due to sintering becomes uniform, whereby the deformations such as warpage and depressions do not occur after sintering, and further, it is unnecessary to perform the conventional correcting processing after sintering, which can simplify the manufacturing processes, because the pressure unevenness at the time of pressing disappears. Therefore, it becomes possible to mold the permanent magnet with a high degree of dimension accuracy. Furthermore, even when the permanent magnet is reduced in film thickness, the magnetic characteristics are not deteriorated by the processing-deteriorated layer on the surface.

In addition, the surfaces of the pulverized magnet particles are coated with the high-melting metal element-containing organic compound or the precursor of the high-melting ceramic by performing wet mixing, so that the grain growth of the magnet particles at the time of sintering can be inhibited. Accordingly, it becomes possible to manufacture the permanent magnet in which the crystal grain size of the sintered body is adjusted to 3 μm or less to improve the magnetic performance.

Further, according to the method for manufacturing a permanent magnet described in the above (5), the permanent magnet is manufactured by sintering the green sheet obtained by mixing the magnet raw material with the resin binder and molding the resulting mixture. Accordingly, the contraction due to sintering becomes uniform, whereby the deformations such as warpage and depressions do not occur after sintering, and further, it is unnecessary to perform the conventional correcting processing after sintering, which can simplify the manufacturing processes, because the pressure unevenness at the time of pressing disappears. Therefore, it becomes possible to mold the permanent magnet with a high degree of dimension accuracy. Furthermore, even when the permanent magnet is reduced in film thickness, the magnetic characteristics are not deteriorated by the processing-deteriorated layer on the surface.

In addition, the surfaces of the pulverized magnet particles are coated with the high-melting metal element-containing organic compound or the precursor of the high-melting ceramic by performing wet mixing, so that the grain growth of the magnet particles at the time of sintering can be inhibited. Accordingly, it becomes possible to manufacture the permanent magnet in which the crystal grain size of the sintered body is adjusted to 3 μm or less to improve the magnetic performance.

MODE FOR CARRYING OUT THE INVENTION

A specific embodiment of a permanent magnet and a method for manufacturing the permanent magnet according to the invention will be described below in detail with reference to the drawings.

Constitution of Permanent Magnet

First, a constitution of a permanent magnet 1 will be described using FIGS. 1 to 3. Incidentally, in this embodiment, particularly, an explanation is given taking the permanent magnet 1 buried in a VCM as an example.

The permanent magnet 1 according to this embodiment is a Nd—Fe—B-based magnet. Further, a high-melting metal element-containing organic compound or a precursor of a high-melting ceramic for inhibiting the grain growth of the permanent magnet 1 at the time of sintering is added. Incidentally, the contents of respective components are regarded as Nd: 27 to 30 wt %, a metal component contained in the high-melting metal element-containing organic compound (or a ceramic component contained in the precursor of the high-melting ceramic): 0.01 to 8 wt %, B: 1 to 2 wt %, and Fe (electrolytic iron): 60 to 70 wt %. Furthermore, the permanent magnet 1 is constituted from a fan-shaped and thin film-like magnet as shown in FIG. 1. FIG. 1 is an overall view showing the permanent magnet 1 according to this embodiment.

The permanent magnet 1 as used herein is a thin film-like permanent magnet having a thickness of 0.1 to 2 mm (2 mm in FIG. 1), and is prepared by sintering a green sheet molded from a Nd magnet powder in a slurry state as described later.

Figure 2:
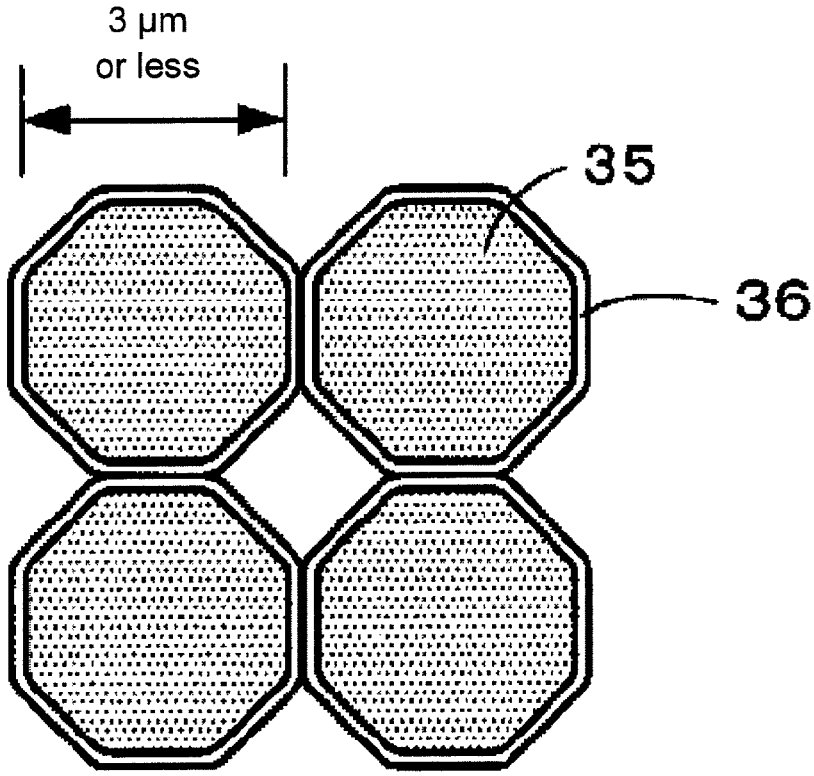
FIG. 2 is an enlarged view showing Nd magnet particles constituting a permanent magnet.

Further, in the permanent magnet 1 according to this embodiment, surfaces of Nd magnet particles 35 constituting the permanent magnet are coated with layers 36 of the high-melting metal element-containing organic compound or the precursor of the high-melting ceramic (hereinafter referred to as grain growth inhibiting layers 36) as shown in FIG. 2. Further, the grain size of the Nd magnet particles 35 is 3 μm or less. FIG. 2 is an enlarged view showing the Nd magnet particles constituting the permanent magnet 1.

And the grain growth inhibiting layers 36 coated on the surfaces of the Nd magnet particles 35 inhibit the grain growth of the Nd magnet particles 35 at the time of sintering. A mechanism of inhibiting the grain growth of the permanent magnet 1 with the grain growth inhibiting layers 36 will be described below using FIG. 3. FIG. 3 is a schematic view showing a magnetic domain structure of a ferromagnetic body.

In general, a grain boundary as a discontinuous boundary face left between a crystal and another crystal has excessive energy, so that grain boundary migration which tends to decrease the energy occurs at high temperature. Accordingly, when sintering of the magnet raw material is performed at high temperature (for example, 1,100 to 1,150° C. for the Nd—Fe—B-based magnet, the so-called grain growth occurs in which small magnet particles contract to disappear and the average grain size of the remaining magnet particles increases.

Here, in this embodiment, when the magnet powder is finely pulverized by wet pulverization as described later, the high-melting metal element-containing organic compound or the precursor of the high-melting ceramic and a dispersing agent are added in slight amounts (for example, such an amount that the content of the metal contained in the organic compound or the ceramic component reaches 0.01 to 8 wt % based on the magnet powder). This causes the high-melting metal element-containing organic compound or the precursor of the high-melting ceramic to be uniformly adhered to the particle surfaces of the Nd magnet particles 35 by wet dispersion to form the grain growth inhibiting layers 36 shown in FIG. 2, when the magnet powder to which the high-melting metal element-containing organic compound or the precursor of the high-melting ceramic has been added is sintered thereafter. Further, the melting point of the high-melting metal element-containing organic compound or the precursor of the high-melting ceramic is far higher than the sintering temperature of the magnet raw material (for example, 1,100 to 1,150° C. for the Nd—Fe—B-based magnet), so that the high-melting metal element-containing organic compound or the precursor of the high-melting ceramic can be prevented from being diffused and penetrated (solid-solutionized) into the Nd magnet particles 35 at the time of sintering.

Figure 3:
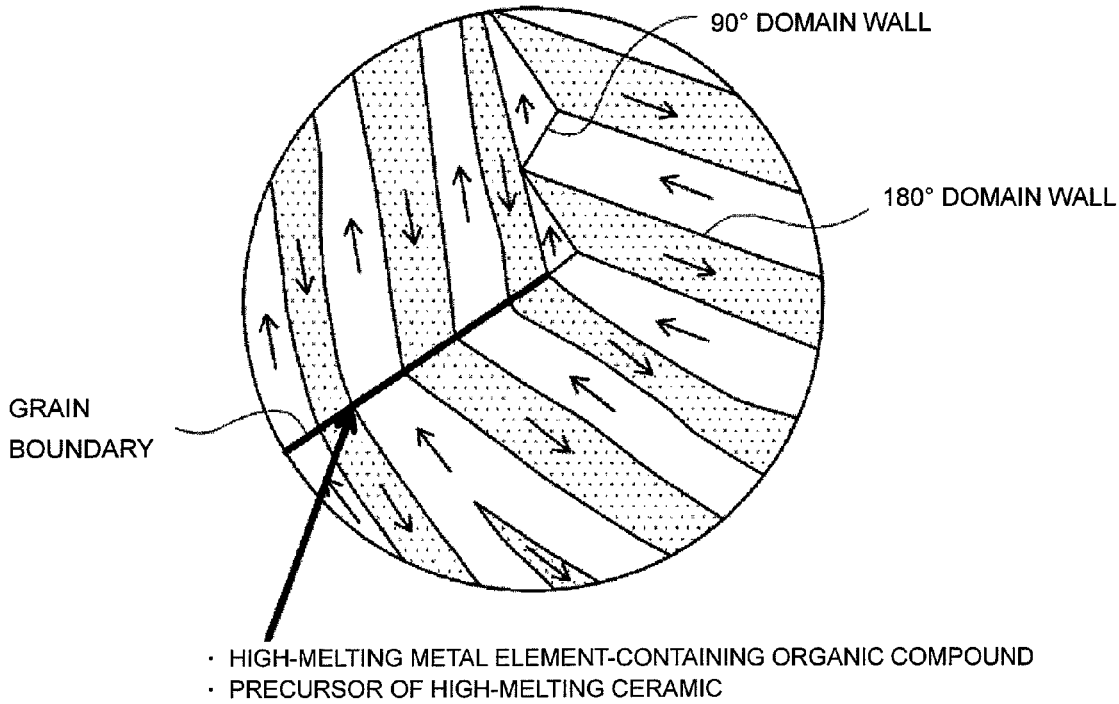
FIG. 3 is a schematic view showing a magnetic domain structure of a ferromagnetic body.

As a result, the high-melting metal element-containing organic compound or the precursor of the high-melting ceramic is unevenly distributed in the boundary face of the magnet particle as shown in FIG. 3. Then, the grain boundary migration which occurs at high temperature is prevented by the high-melting metal element-containing organic compound or the precursor of the high-melting ceramic unevenly distributed, thereby being able to inhibit the grain growth.

On the other hand, it has been known that the magnetic characteristics of the permanent magnet are basically improved by miniaturizing the crystal grain size of the sintered body, because the magnetic characteristics of the magnet is derived by a single-domain fine particle theory. In general, when the crystal grain size of the sintered body is adjusted to 3 μm or less, it becomes possible to sufficiently improve the magnetic performance. Here, in this embodiment, the grain growth of the Nd magnet particles 35 at the time of sintering can be inhibited by the grain growth inhibiting layers 36 as described above. Accordingly, when the grain size of the magnet raw material before sintering is adjusted to 3 μm or less, the grain size of the Nd magnet particles 35 of the permanent magnet 1 after sintering can also be adjusted to 3 μm or less.

Further, in this embodiment, when the magnet powder molded by wet molding is sintered under proper sintering conditions, the high-melting metal element-containing organic compound or the precursor of the high-melting ceramic can be prevented from being diffused and penetrated (solid-solutionized) into the Nd magnet particles 35 as described above. Here, it is known that the diffusion and penetration of the high-melting metal element-containing organic compound or the precursor of the high-melting ceramic into the magnet particles 35 decreases the residual magnetization (magnetization at the time when the intensity of the magnetic field is made zero) of the magnet. Accordingly, in this embodiment, the residual magnetization of the permanent magnet 1 can be prevented from being decreased.

Incidentally, the grain growth inhibiting layers 36 is not required to be a layer composed of only the high-melting metal element-containing organic compound or the precursor of the high-melting ceramic, and may be a layer composed of a mixture of the high-melting metal element-containing organic compound or the precursor of the high-melting ceramic and Nd. In that case, the layer composed of the mixture of the high-melting metal element-containing organic compound or the precursor of the high-melting ceramic and a Nd compound is formed by adding the Nd compound. As a result, liquid-phase sintering of the Nd magnet powder at the time of sintering can be promoted. Incidentally, as the Nd compound to be added, desirable is neodymium acetate hydrate, neodymium (III) acetylacetonate trihydrate, neodymium (III) 2-ethylhexanoate, neodymium (III) hexafluoroacetylacetonate dehydrate, neodymium isopropoxide, neodymium (III) phosphate n-hydrate, neodymium trifluoroacetylacetonate, neodymium trifluoromethanesulfonate or the like.

Method for Manufacturing Permanent Magnet

Figure 4:
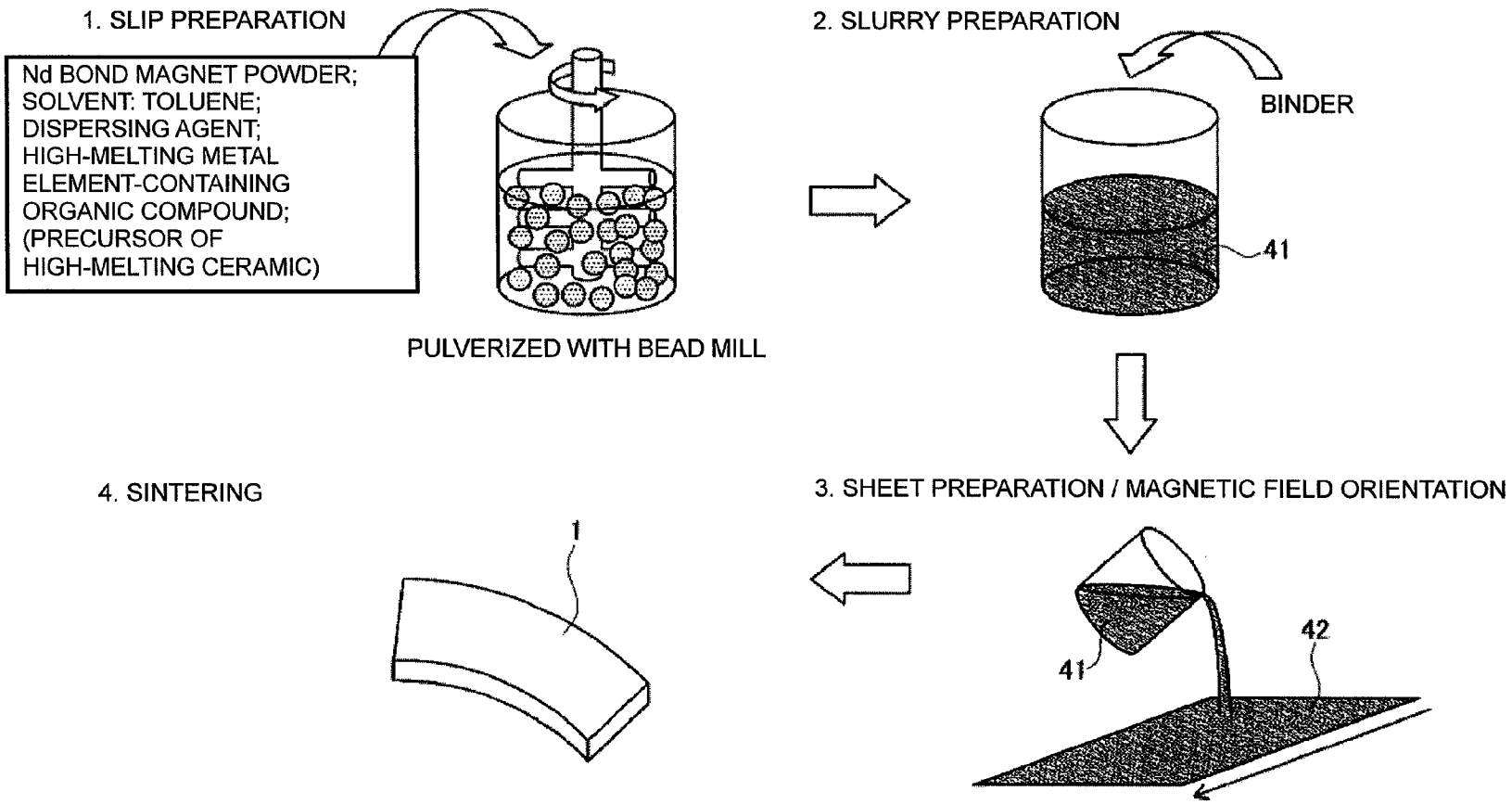
FIG. 4 is an explanatory view showing a manufacturing process of the permanent magnet according to the present embodiment.
Figure 5:
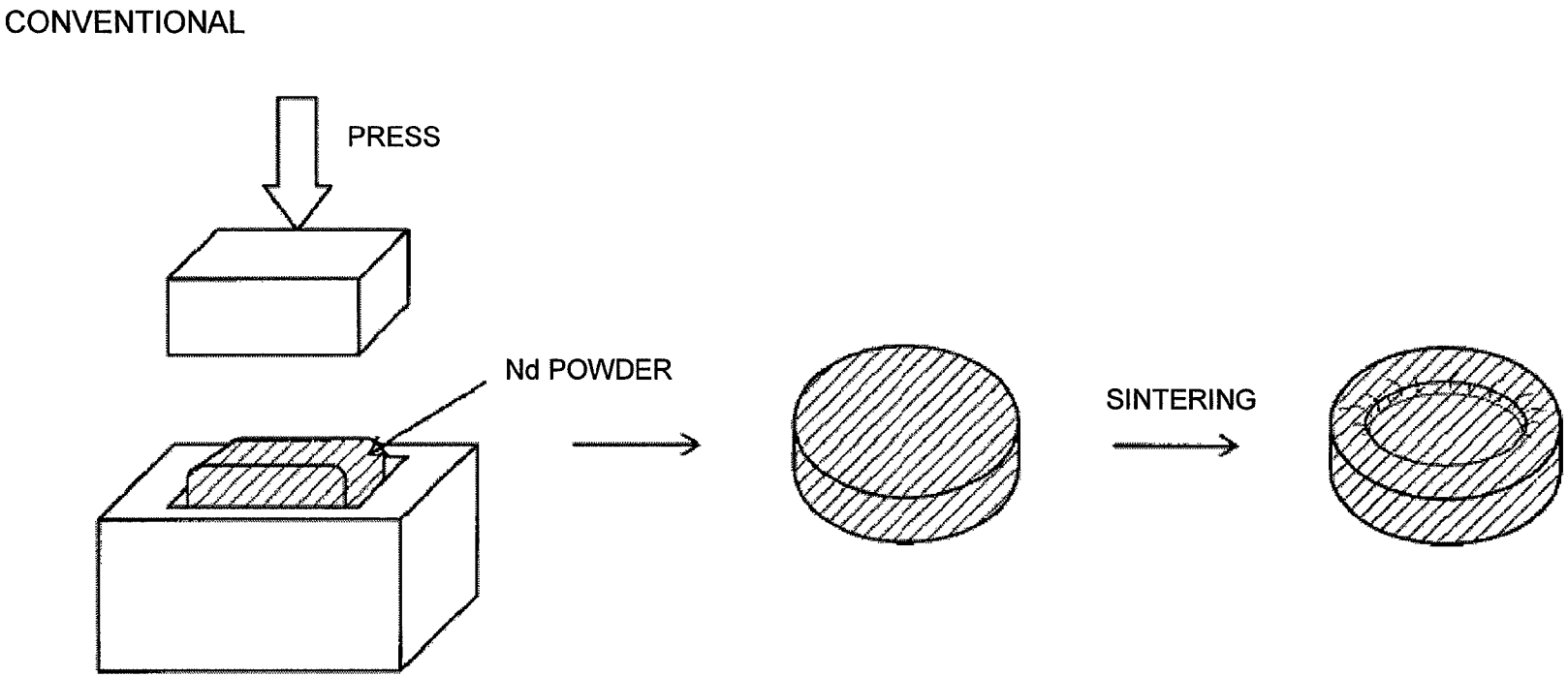
FIG. 5 is an explanatory view showing a manufacturing process of a conventional permanent magnet.

A method for manufacturing the permanent magnet 1 according to this embodiment will be described below using FIG. 4. FIG. 4 is an explanatory view showing a manufacturing process of the permanent magnet 1 according to this embodiment.

First, an ingot including 27 to 30 wt % of Nd, 60 to 70 wt % of Fe and 1 to 2 wt % of B is produced. Thereafter, the ingot is crudely pulverized to a size of about 200 μm with a stamp mill, a crusher or the like.

Then, the crudely pulverized magnet powder is finely pulverized to an average grain size of 3 μm or less by a wet method using a bead mill, and the magnet powder is dispersed in a solution to prepare a slip. Incidentally, in the wet pulverization, 4 kg of toluene based on 5 kg of the magnet powder is used as a solvent, and 0.05 kg of a phosphate-based dispersing agent is further added as a dispersing agent. Further, during the wet pulverization, the high-melting metal element-containing organic compound is added so as to give a metal component content of 0.01 to 8 wt % based on the magnet powder, or the precursor of the high-melting ceramic is added so as to give a ceramic component content of 0.01 to 8 wt % based on the magnet powder, thereby dispersing the high-melting metal element-containing organic compound or the precursor of the high-melting ceramic in the solvent together with the magnet powder. Incidentally, detailed dispersing conditions are as follows:

Dispersing device: bead mill

Dispersing medium: zirconia beads

As the high-melting metal element-containing organic compound or the precursor of the high-melting ceramic added herein, an organic compound of Ta, Mo, W or Nb, or a precursor of BN or AlN may be used. More specifically, one soluble in the solvent of the slurry is appropriately selected to use from tantalum (V) ethoxide, tantalum (V) methoxide, tantalum (V) tetraethoxyacetylacetonate, tantalum (V) (tetraethoxy) [BREW], tantalum (V) trifluoroethoxide, tantalum (V) 2,2,2-trifluoroethoxide, tantalum tris(diethylamido)-t-butylimide, tungsten (VI) ethoxide, hexacarbonyl tungsten, 12-tungsto (VI) phosphoric acid n-hydrate, tungstosilicic acid n-hydrate, 12-tungsto (VI) silicic acid 26-hydrate, niobium n-butoxide, niobium (IV) chloride-tetrahydrofuran complex, niobium (V) ethoxide, niobium (IV) 2-ethylhexanoate, niobium phenoxide, molybdenum (II) acetate dimer, molybdenum (VI) dioxide bis(acetylacetonate), molybdenum (VI) dioxide bis(2,2,6,6-tetramethyl-3,5-heptanedionate), molybdenum 2-ethylhexanoate, molybdenum hexacarbonyl, 12-molybdo (VI) phosphoric acid n-hydrate, molybdenum (VI) dioxide bis(acetylacetonate), 12-molybdosilicic acid n-hydrate and the like.

Further, even when insoluble in the solvent, the high-melting metal element-containing organic compound or the precursor of the high-melting ceramic which has been pulverized into fine particles is added at the time of wet dispersion, and uniformly dispersed, whereby it becomes possible to uniformly adhere it to the particle surfaces of the Nd magnet particles.

Furthermore, there is no particular limitation on the solvent used for pulverization, and there can be used an alcohol such as isopropyl alcohol, ethanol or methanol, a lower hydrocarbon such as pentane or hexane, an aromatic compound such as benzene, toluene or xylene, a ketone, a mixture thereof or the like. In particular, isopropyl alcohol or the like is preferred.

After dispersion of the magnet powder, a resin binder is added to and mixed with the slip prepared. Subsequently, the magnet powder and the resin binder are kneaded to produce a slurry 41. Incidentally, a material used as the resin binder is not particularly limited, and is each of various thermoplastic resin single substances or mixtures thereof, or various thermosetting resin single substances or mixtures thereof. Physical properties, natures and the like of the respective ones may be any, as long as they are within the range in which desired characteristics are obtained. For example, a methacrylic resin may be mentioned.

Subsequently, a green sheet 42 is formed from the slurry 41 produced. A method for forming the green sheet 42 can be performed, for example, by a method of coating a supporting substrate such as a separator as needed with the produced slurry 41 by an appropriate system, followed by drying, or the like. Incidentally, the coating system is preferably a system excellent in layer thickness controllability, such as a doctor blade method. Further, it is preferred that a defoaming treatment is sufficiently performed so that no air bubbles remain in a developed layer, by combined use of a defoaming agent or the like. Incidentally, detailed coating conditions are as follows:

Coating system: doctor blade

Gap: 1 mm

Supporting substrate: silicone-treated polyester film

Drying conditions: 130° C.×30 min after 90° C.×10 min

Further, a pulsed field is applied to the green sheet 42 coated on the supporting substrate, in a direction crossing to a transfer direction, thereby orientating the magnetic field in a desired direction. Incidentally, it is necessary to determine the direction in which the magnetic field is orientated, taking into consideration the magnetic field direction required for the permanent magnet 1 molded from the green sheet 42.

Figure 1:
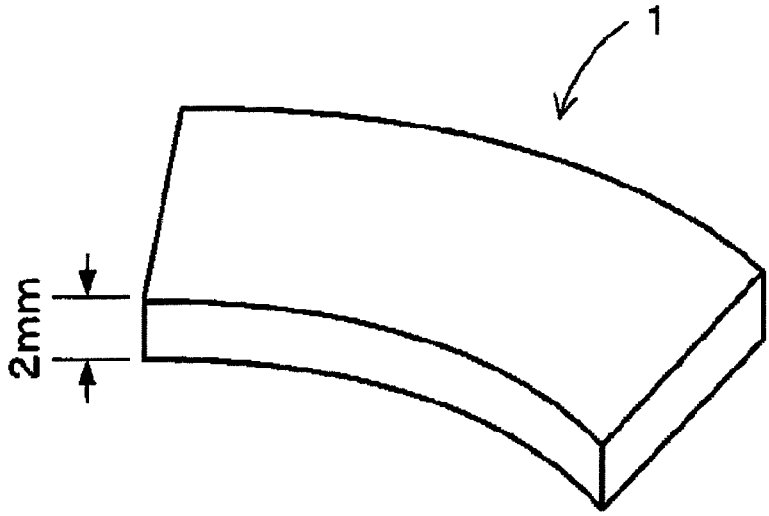
FIG. 1 is an overall view showing a permanent magnet according to the present embodiment.

Then, the green sheet 42 formed from the slurry 41 is divided into a desired product shape (for example, in this embodiment, the fan shape shown in FIG. 1). Thereafter, sintering is performed at 1,100° C. to 1,150° C. for about 1 hour. Incidentally, the sintering is performed under an Ar or vacuum atmosphere, and as a result of the sintering, the permanent magnet 1 composed of a sheet-like magnet is manufactured.

As described above, in the permanent magnet 1 and the method for manufacturing the permanent magnet 1 according to this embodiment, the magnet raw material including 27 to 30 wt % of Nd, 60 to 70 wt % of Fe and 1 to 2 wt % of B is pulverized to the fine powder having a grain size of 3 μm or less by the wet pulverization, and the high-melting metal element-containing organic compound is added so as to give a metal component content of 0.01 to 8 wt % based on the magnet powder, or the precursor of the high-melting ceramic is added so as to give a ceramic component content of 0.01 to 8 wt % based on the magnet powder, thereby dispersing the high-melting metal element-containing organic compound or the precursor of the high-melting ceramic in the solvent together with the magnet raw material. Thereafter, the resin binder is added to the solvent, and the magnet powder and the resin binder are kneaded to produce the slurry 41. Then, the green sheet 42 obtained by molding the produced slurry 41 into a sheet form is sintered, thereby manufacturing the permanent magnet 1. Accordingly, the contraction due to sintering becomes uniform, whereby the deformations such as warpage and depressions do not occur after sintering, and further, it is unnecessary to perform the conventional correcting processing after sintering, which can simplify the manufacturing processes, because the pressure unevenness at the time of pressing disappears. Therefore, it becomes possible to mold the permanent magnet 1 with a high degree of dimension accuracy. Furthermore, even when the permanent magnet 1 reduced in film thickness is manufactured, the magnetic characteristics of the permanent magnet 1 are not deteriorated by the processing-deteriorated layer on the surface.

In addition, the surfaces of the pulverized magnet particles are coated with the high-melting metal element-containing organic compound or the precursor of the high-melting ceramic wet-mixed in the solvent together with the magnet powder, thereby being able to inhibit the grain growth of the magnet particles at the time of sintering. Accordingly, it becomes possible to adjust the crystal grain size of the sintered body to 3 μm or less to improve the magnetic performance of the permanent magnet.

Moreover, the high-melting metal element-containing organic compound or the precursor of the high-melting ceramic is unevenly distributed in the grain boundary of the magnet raw material after sintering, so that it becomes possible to inhibit the grain growth of the magnet particles at the time of sintering without decreasing the residual magnetization of the magnet.

Incidentally, the invention should not be construed as being limited to the above-mentioned example, and various improvements and modifications are of course possible within the range not departing from the gist of the invention.

For example, in this embodiment, as the method for dispersing the magnet powder and the high-melting metal element-containing organic compound or the precursor of the high-melting ceramic in the solvent, the crudely pulverized magnet powder is wet-pulverized in the solvent together with the high-melting metal element-containing organic compound or the precursor of the high-melting ceramic, thereby dispersing them in the solvent, as shown in FIG. 4. However, it is also possible to disperse them by the following method.

(1) First, the crudely pulverized magnet powder is finely pulverized to a magnet powder having an average grain size of about 3 μm or less by dry pulverization using a ball mill, a jet mill or the like.

(2) Then, the finely pulverized magnet powder is added to the solvent, and allowed to be uniformly dispersed in the solvent. In that case, the dispersing agent and the high-melting metal element-containing organic compound or the precursor of the high-melting ceramic are also added to the solvent.

(3) The magnet powder and the resin powder dispersed in the solvent are kneaded to produce the slurry 41.

It becomes possible to manufacture the permanent magnet having the same constitution as in this embodiment by hereinafter performing the same treatment as in this embodiment.

Further, in this embodiment, description is made taking the permanent magnet buried in the VCM as an example. However, it is also of course possible to be applied to the permanent magnet buried in a permanent magnet motor such as a vibration motor mounted on a cellular phone, a driving motor mounted on a hybrid car or a spindle motor for rotating a disk of a hard disk drive.

Furthermore, the pulverizing conditions, kneading conditions and sintering conditions of the magnet powder should not be construed as being limited to the conditions described in the above-mentioned example.

While the invention has been described in detail with reference to the specific embodiment thereof, it will be apparent to one skilled in the art that various changes and modifications can be made therein without departing from the spirit and scope of the invention.

Incidentally, this application is based on Japanese Patent Application No. 2008-105759 filed on Apr. 15, 2008, the entire contents of which are incorporated herein by reference.

Further, all references cited herein are incorporated by reference in their entirety.

INDUSTRIAL APPLICABILITY

According to the permanent magnet of the invention, the permanent magnet has the above-mentioned constitution. Accordingly, the contraction due to sintering becomes uniform, whereby the deformations such as warpage and depressions do not occur after sintering, and further, it is unnecessary to perform the conventional correcting processing after sintering, which can simplify the manufacturing processes, because the pressure unevenness at the time of pressing disappears. Therefore, it becomes possible to mold the permanent magnet with a high degree of dimension accuracy. Furthermore, even when the permanent magnet is reduced in film thickness, the magnetic characteristics are not deteriorated by the processing-deteriorated layer on the surface. In addition, the surfaces of the pulverized magnet particles are coated with the high-melting metal element-containing organic compound or the precursor of the high-melting ceramic by performing wet mixing, so that the grain growth of the magnet particles at the time of sintering can be inhibited. Accordingly, it becomes possible to adjust the crystal grain size of the sintered body to 3 μm or less to improve the magnetic performance.

DESCRIPTION OF REFERENCE NUMERALS AND SIGNS

1: Permanent magnet
35: Nd magnet particle
36: Grain growth inhibiting layer
41: Slurry
42: Green sheet

The invention claimed is:

1. A permanent magnet manufactured by steps of:

wet-pulverizing a high-melting metal element-containing organic compound or a precursor of a high-melting ceramic in a solvent together with a magnet raw material to pulverize the magnet raw material into fine particles having a grain size of 3 μm or less and to coat a surface of the pulverized magnet raw material with the high-melting metal element-containing organic compound or the precursor of the high-melting ceramic;

adding a resin binder to the magnet raw material coated with the high-melting metal element-containing organic compound or the precursor of the high-melting ceramic;

producing a slurry by kneading the magnet raw material and the resin binder;

molding the slurry into a sheet form to prepare a green sheet; and sintering the green sheet, wherein the permanent magnet is Nd—Fe—B-based and contains 27 to 30 weight % Nd, 60 to 70 weight % Fe, and 1 to 2 weight % B, and wherein the high-melting metal element containing organic compound is an organic compound containing Ta, Mo, W or Nb, and the precursor of a high-melting ceramic is a precursor of BN or AIN.

2. A permanent magnet manufactured by steps of:

pulverizing a magnet raw material into fine particles having a grain size of 3 μm or less;

wet-mixing a high-melting metal element-containing organic compound or a precursor of a high-melting ceramic in a solvent together with the pulverized magnet raw material, thereby coating a surface of the pulverized magnet raw material with the high-melting metal element-containing organic compound or the precursor of the high-melting ceramic;

adding a resin binder to the magnet raw material coated with the high-melting metal element-containing organic compound or the precursor of the high-melting ceramic;

producing a slurry by kneading the magnet raw material and the resin binder;

molding the slurry into a sheet form to prepare a green sheet; and sintering the green sheet, wherein the permanent magnet is Nd—Fe—B-based and contains 27 to 30 weight % Nd, 60 to 70 weight % Fe, and 1 to 2 weight % B, and wherein the high-melting metal element containing organic compound is an organic compound containing Ta, Mo, W or Nb, and the precursor of a high-melting ceramic is a precursor of BN or AIN.

3. The permanent magnet according to claim 1, wherein the high-melting metal element-containing organic compound or the precursor of the high-melting ceramic is unevenly distributed in a grain boundary of the magnet raw material after sintering.

4. A method for manufacturing a permanent magnet comprising steps of:

wet-pulverizing a high-melting metal element-containing organic compound or a precursor of a high-melting ceramic in a solvent together with a magnet raw material to pulverize the magnet raw material into fine particles having a grain size of 3 μm or less and to coat a surface of the pulverized magnet raw material with the high-melting metal element-containing organic compound or the precursor of the high-melting ceramic;

adding a resin binder to the magnet raw material coated with the high-melting metal element-containing organic compound or the precursor of the high-melting ceramic;

producing a slurry by kneading the magnet raw material and the resin binder;

molding the slurry into a sheet form to prepare a green sheet; and sintering the green sheet, wherein the permanent magnet is Nd—Fe—B-based and contains 27 to 30 weight % Nd, 60 to 70 weight % Fe, and 1 to 2 weight % B, and wherein the high-melting metal element containing organic compound is an organic compound containing Ta, Mo, W or Nb, and the precursor of a high-melting ceramic is a precursor of BN or AIN.

5. A method for manufacturing a permanent magnet comprising steps of:

pulverizing a magnet raw material into fine particles having a grain size of 3 μm or less;

wet-mixing a high-melting metal element-containing organic compound or a precursor of a high-melting ceramic in a solvent together with the pulverized magnet raw material, thereby coating a surface of the pulverized magnet raw material with the high-melting metal element-containing organic compound or the precursor of the high-melting ceramic;

adding a resin binder to the magnet raw material coated with the high-melting metal element-containing organic compound or the precursor of the high-melting ceramic;

producing a slurry by kneading the magnet raw material and the resin binder;

molding the slurry into a sheet form to prepare a green sheet; and sintering the green sheet, wherein the permanent magnet is Nd—Fe—B-based and contains 27 to 30 weight % Nd, 60 to 70 weight % Fe, and 1 to 2 weight % B, and wherein the high-melting metal element containing organic compound is an organic compound containing Ta, Mo, W or Nb, and the precursor of a high-melting ceramic is a precursor of BN or AIN.

6. The permanent magnet according to claim 2, wherein the high-melting metal element-containing organic compound or the precursor of the high-melting ceramic is unevenly distributed in a grain boundary of the magnet raw material after sintering.

* * * * *